US005904273A

United States Patent [19]

Aspacher et al.

[11] Patent Number: 5,904,273

[45] Date of Patent: May 18, 1999

[54] EASY SPRAY CAN HOLDER

[76] Inventors: John C. Aspacher; Sandra Aspacher, both of 965 N. Alamo Ave., Tucson, Ariz. 85711

[21] Appl. No.: 09/102,109

[22] Filed: Jun. 22, 1998

[51] Int. Cl.[6] ..... B05B 5/03

[52] U.S. Cl. ..... 222/402.15; 222/473; 239/375

[58] Field of Search ..... 222/402.15, 470, 222/472, 473, 474; 239/375

[56] References Cited

U.S. PATENT DOCUMENTS

| | | | |
|---|---|---|---|
| 2,720,422 | 10/1955 | Mercur | 239/375 |
| 4,040,543 | 8/1977 | Guillen | 222/473 |
| 4,971,257 | 11/1990 | Birge | 222/402.15 |

*Primary Examiner*—Steven O. Douglas

[57] ABSTRACT

An easy spray can holder including a unitary trigger arm that has a first linear portion and a second linear portion. The first linear portion has a trigger extension and the second linear portion having a finger grip. An L-shaped body member is in receipt of the trigger arm. The L-shaped body member has a first body portion with a second body portion extending outwardly. The first body portion is generally cylindrical with an upper member and a lower member separated by a thumb rest. The second body portion is generally rectangular and has a bottom side adjacent the thumb rest. The bottom side of the second body member has a second lower extent that is spaced from a first lower extent to form a lateral gap. Finally, an adjustable bracket is sized for receiving an aerosol can. The adjustable bracket has a support plate with an elongated second extent. The elongated second extent is sized and shaped to be positioned within the lateral gap of the second body portion of the L-shaped body member.

8 Claims, 2 Drawing Sheets

24
26
14
67
62
18
80
76
52
74
16
68
65
64
66
84
56
78
102
82
32
4
4
54
98
92
28
94

98

90
96
94

EASY SPRAY CAN HOLDER

BACKGROUND OF THE INVENTION

1. Field of the Invention

The present invention relates to a easy spray can holder and more particularly pertains to providing an apparatus that attaches a spray can and engages the nozzle of the spray can for the release of the material within.

2. Description of the Prior Art

The use of a holder for an aerosol can is known in the prior art. More specifically, holders for aerosol cans heretofore devised and utilized for the purpose of actuating the aerosol can are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,323,937 to Brody discloses a spray can actuation device with improved can retention. U.S. Pat. No. 4,089,440 to Lee discloses a handle support and operating assembly for an aerosol spray can. Lastly, U.S. Pat. No. 4,098,436 to Kohlbeck discloses a holder to convert a spray can into a spray gun.

In this respect, the easy spray can holder according to the present invention substantially departs from the conventional concepts and designs of the prior art, and in so doing provides an apparatus primarily developed for the purpose of providing apparatus that attaches a spray can and engages the nozzle of the spray can for the release of the material within.

Therefore, it can be appreciated that there exists a continuing need for a new and improved easy spray can holder which can be used for providing an apparatus that attaches a spray can and engages the nozzle of the spray can for the release of the material within. In this regard, the present invention substantially fulfills this need.

SUMMARY OF THE INVENTION

In view of the foregoing disadvantages inherent in the known types of holders for aerosol cans now present in the prior art, the present invention provides an improved easy spray can holder. As such, the general purpose of the present invention, which will be described subsequently in greater detail, is to provide a new and improved easy spray can holder which has all the advantages of the prior art and none of the disadvantages.

To attain this, the present invention essentially comprises a unitary trigger arm. The trigger arm has a first linear portion with a second linear portion extending from the first linear portion. A reinforcement bar is connected to the first and second linear portion. The first linear portion has a trigger extension with an angular edge. The second linear portion has a finger grip with at least four openings.

Included is an L-shaped first section and an L-shaped second section. The L-shaped second section is configured similarly to the L-shaped first section. A plurality of means are provided for selectively coupling the L-shaped first section and the L-shaped second section to form an L-shaped body member. The body member has a first body portion with a second body portion extending outwardly. The first body portion is generally cylindrical with an upper member and a lower member. The upper member and the lower member are separated by a thumb rest. The second body portion is generally rectangular and has a bottom side adjacent the thumb rest. The L-shaped body member is in receipt of the trigger arm. The first linear portion of the trigger arm projects from the upper member of the first body portion. The second linear portion extends from the bottom side of the second body portion and has the finger grip spaced from the lower member of the first body portion.

Also, the second body portion has a front plate that extends from an upper side. The front plate has an upper overhang and a first lower extent. The bottom side of the second body member has a second lower extent that is spaced from the first lower extent to form a lateral gap between the extents.

Finally, an adjustable bracket is included. The adjustable bracket is sized for receiving an aerosol can. The adjustable bracket has a support plate with a first extent and an elongated second extent. The elongated second extent is sized and shaped to be positioned within the lateral gap of the second body portion of the L-shaped body member. The elongated second extent is movable within the lateral gap. This movement allows for an increase and decrease in the distance between the support plate and the second body portion when the aerosol can is positioned between the trigger extension and the support plate.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved easy spray can holder which has all the advantages of the prior art holders for aerosol cans and none of the disadvantages.

It is another object of the present invention to provide a new and improved easy spray can holder which may be easily and efficiently manufactured and marketed.

It is a further object of the present invention to provide a new and improved easy spray can holder which is of a durable and reliable construction.

An even further object of the present invention is to provide a new and improved easy spray can holder which is susceptible of a low cost of manufacture with regard to both materials and labor, and which accordingly is then susceptible of low prices of sale to the consuming public, thereby making such easy spray can holder economically available to the buying public.

Still yet another object of the present invention is to provide a new and improved easy spray can holder which provides in the apparatuses and methods of the prior art some of the advantages thereof, while simultaneously overcoming some of the disadvantages normally associated therewith.

Still another object of the present invention is to provide an apparatus that attaches a spray can and engages the nozzle of the spray can for the release of the material within.

Lastly, it is an object of the present invention to provide a new and improved a unitary trigger arm that has a first linear portion and a second linear portion. The first linear portion has a trigger extension and the second linear portion having a finger grip. An L-shaped body member is in receipt of the trigger arm. The L-shaped body member has a first body portion with a second body portion extending outwardly. The first body portion is generally cylindrical with an upper member and a lower member separated by a thumb rest. The second body portion is generally rectangular and has a bottom side adjacent the thumb rest. The bottom side of the second body member has a second lower extent that is spaced from a first lower extent to form a lateral gap. Finally, an adjustable bracket is sized for receiving an aerosol can. The adjustable bracket has a support plate with an elongated second extent. The elongated second extent is sized and shaped to be positioned within the lateral gap of the second body portion of the L-shaped body member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
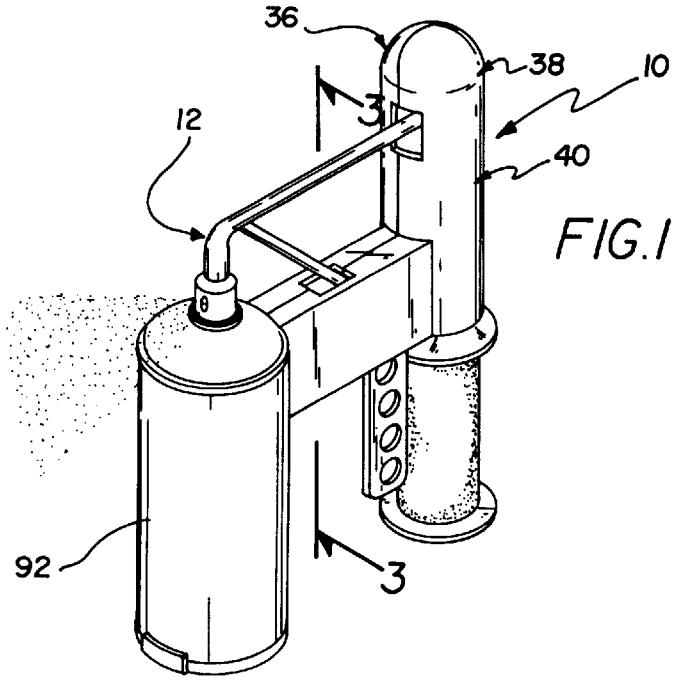
FIG. 1 is a perspective illustration of the preferred embodiment of the easy spray can holder constructed in accordance with the principles of the present invention.

With reference now to the drawings, and in particular to FIG. 1 thereof, a new and improved easy spray can holder embodying the principles and concepts of the present invention and generally designated by the reference numeral 10 will be described.

The present invention, the new and improved easy spray can holder, is comprised of a plurality of components. Such components in their broadest context include a trigger arm and an L-shaped body member. Such components are individually configured and correlated with respect to each other so as to attain the desired objective.

Figure 3:
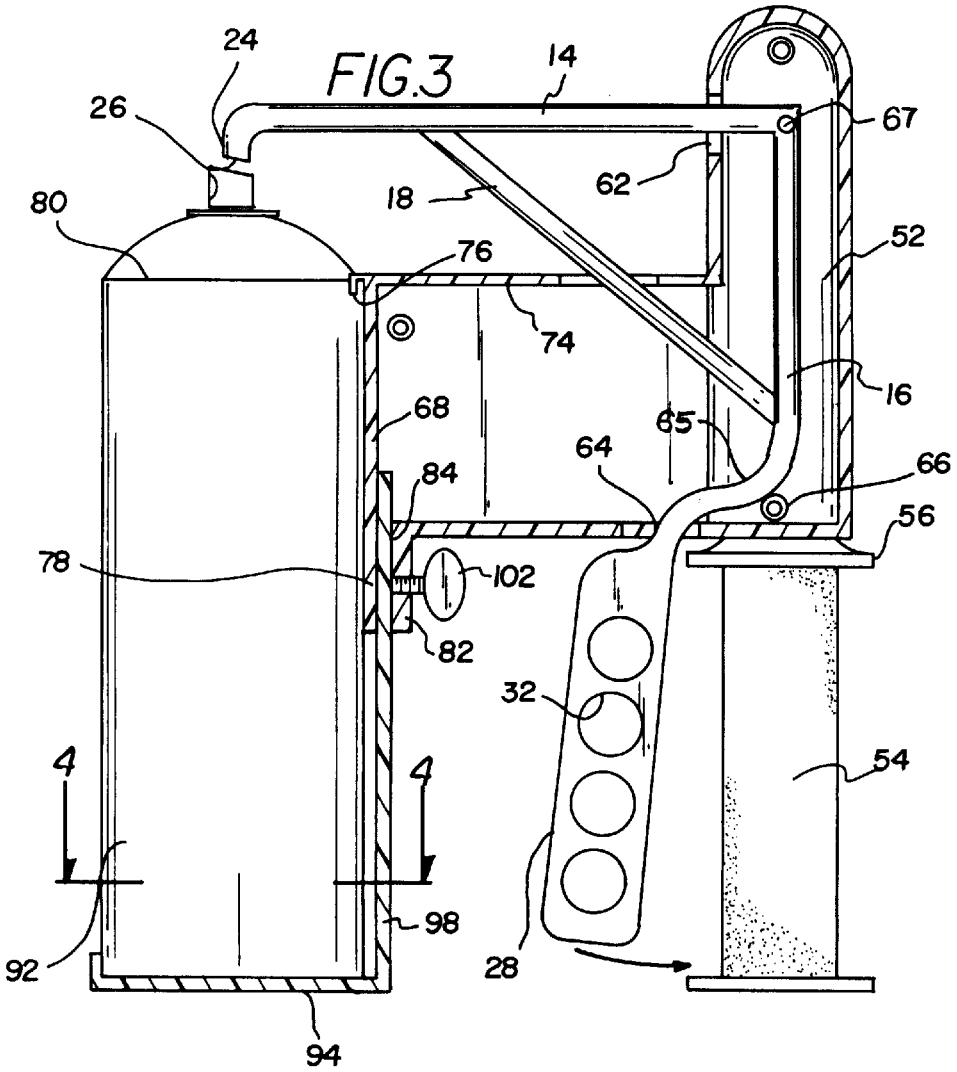
FIG. 3 is a cross sectional view of the easy spray can holder.

More specifically, the present invention includes a unitary trigger arm 12. The trigger arm has a first linear portion 14 with a second linear portion 16 extending from the first linear portion. A reinforcement bar 18 is connected to the first and second linear portion. FIG. 3 shows the trigger arm in its entirety. The first linear portion has a trigger extension 24 with an angular edge 26. The second linear portion has a finger grip 28 with at least four openings 32.

Figure 2:
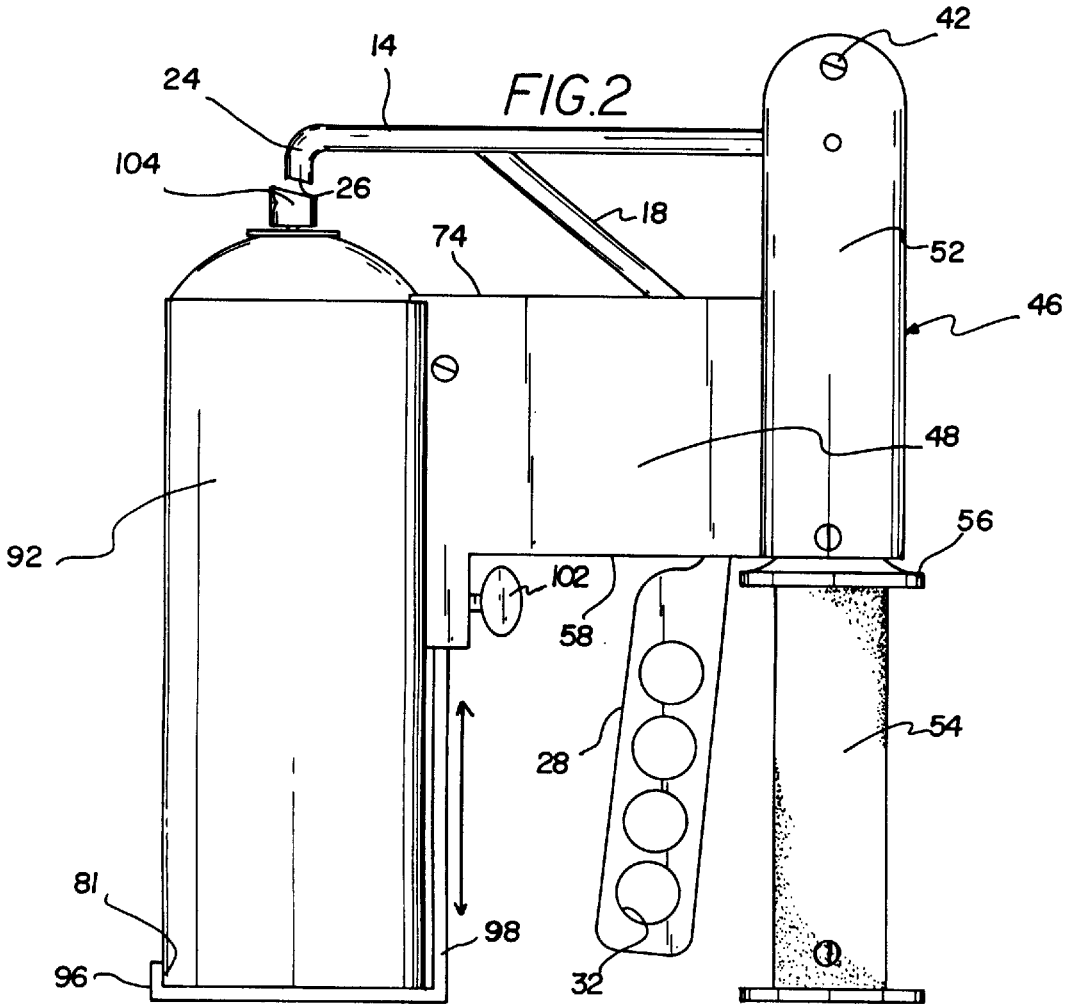
FIG. 2 is a side view of the present invention of FIG. 1.

Included is an L-shaped first section 36 and an L-shaped second section 38, as shown in FIG. 1. The L-shaped second section is configured similarly to the L-shaped first section. A plurality of means are provided for selectively coupling the L-shaped first section and the L-shaped second section to form an L-shaped body member 40. The plurality of means are screws 42 proportionately positioned at various locations of the L-shaped body member, as seen in FIG. 2.

Also, the L-shaped body member has a first body portion 46 with a second body portion 48 extending outwardly. The first body portion is generally cylindrical with an upper member 52 and a lower member 54. The upper member and the lower member are separated by a thumb rest 56. The second body portion is generally rectangular and has a bottom side 58 adjacent the thumb rest. The L-shaped body member is in receipt of the trigger arm 12. The first linear portion of the trigger arm, as seen in FIGS. 1 and 3, project from an opening 62 in the upper member of the first body portion. The second linear portion extends from an opening 64 in the bottom side of the second body portion. The positioning of the second linear portion has the finger grip spaced from the lower member 54 of the first body portion.

Additionally, the second linear portion has a curved portion 65 that is spaced from a lower screw 66 of the plurality of screws 42 that couple the sections of the L-shaped body member. In operation the trigger arm pivots about a pivot pin 67 with a rotation effect. When the trigger arm is depressed against the lower member the trigger extension is moved downward. When the trigger arm is released the trigger extension returns to a resting position. The movement of the trigger arm causes the finger grip to move back and forth with regards to the lower member of the first body portion 46. This movement raises and lowers the first linear portion 14 of the trigger arm.

The second body portion 48, as seen in FIG. 3, has a front plate 68. The front plate extends from an upper side 74. The front plate has an upper overhang 76 and a first lower extent 78. The upper overhang grips an upper edge 80 of the aerosol can and a first lower extent captures a lower edge 81 of the aerosol can. The bottom side of the second body member has a second lower extent 82 that is spaced from the first lower extent to form a lateral gap 84 between the extents.

Figure 4:
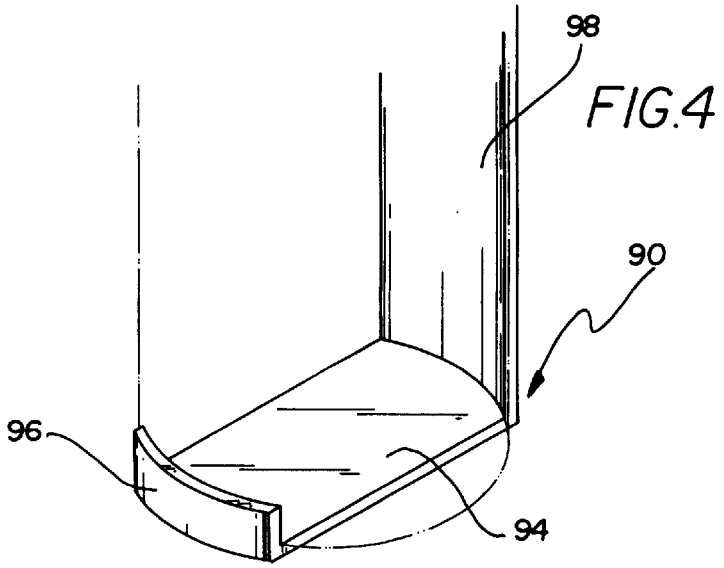
FIG. 4 is a top plan view of the adjustable bracket of the present invention taken along line 4—4 of FIG. 3.

Lastly, an adjustable bracket 90, as seen in FIG. 4, is included. The adjustable bracket is sized for receiving an aerosol can 92. The adjustable bracket has a support plate 94 with a first extent 96 and an elongated second extent 98. The elongated second extent 98 is sized and shaped to be positioned within the lateral gap of the second body portion of the L-shaped body member. The elongated second extent is movable within the lateral gap. The elongated second extent is lock within the lateral gap by a thumb screw 102, as depicted in FIG. 3. This movement allows for an increase and decrease in the distance between the support plate and the second body portion. The variation is distances between the support plate and the second body member is needed when the aerosol can is positioned between the trigger extension and the support plate. Furthermore, when the aerosol can is positioned within the adjustment bracket, the movement of the trigger arm allows the angular edge of the trigger extension 24 to engage the nozzle 104 of the aerosol can.

The present invention is a specially designed gun that attaches to spray cans. The body consist of two halves, one female with threaded holes and one male with four screws attaching to the female. When assembled, you cannot see through the body except in four rectangle openings. These openings are located in the first body portion 46 with a second body portion 48 of the L-shaped body member. Three are where the trigger arm goes in and out an one where the adjustable bracket fits. It features an adjustable bottom rail that will fit all sizes of cans. The sides and body could be formed out of hard plastic and ¼ inch hard plastic rod. A wing nut assembly makes the device simple to adjust to fit any size can. The adjustable bracket fits under the aerosol can to hold it in place, while the over hang hooks over the rim of the can. A finger holed designed finger grip pull-trigger allows the user to control the spray and makes use of the aerosol/spray can easier.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved easy spray can holder comprising in combination:

a unitary trigger arm having a first linear portion and a second linear portion extending therefrom, a reinforcement bar connected to the first and second linear portion, the first linear portion having a trigger extension with an angular edge, the second linear portion having a finger grip with at least four openings therethrough;

an L-shaped first section and an L-shaped second section configured similarly to the L-shaped first section, a plurality of means for selectively coupling the L-shaped first section and the L-shaped second section to form an L-shaped body member, the body member having a first body portion with a second body portion extending outwardly therefrom, the first body portion being generally cylindrical with an upper member and a lower member separated by a thumb rest, the second body portion being generally rectangular and having a bottom side adjacent the thumb rest, the L-shaped body member being in receipt of the trigger arm, the first linear portion of the trigger projecting from the upper member of the first body portion, the second linear portion extending from the bottom side of the second body portion and having the finger grip being spaced from the lower member of the first body portion;

the second body portion having a front plate that extends from an upper side thereof, the front plate having an upper overhang and a first lower extent, the bottom side of the second body member having a second lower extent being spaced from the first lower extent to form a lateral gap therebetween; and an adjustable bracket being sized for receiving an aerosol can, the adjustable bracket having a support plate with a first extent and an elongated second extent, the elongated second extent being sized and shaped to be positioned within the lateral gap of the second body portion of the L-shaped body member, the elongated second extent being movable within the lateral gap for increasing and decreasing the distance between the support plate and the second body portion when positioning the aerosol can between the trigger extension and the support plate.

2. An easy spray can holder comprising:

a unitary trigger arm having a first linear portion and a second linear portion extending therefrom, the first linear portion having a trigger extension and the second linear portion having a finger grip;

an L-shaped body member being in receipt of the trigger arm, the L-shaped body member having a first body portion with a second body portion extending outwardly therefrom, the first body portion being generally cylindrical with an upper member and a lower member separated by a thumb rest, the second body portion being generally rectangular and having a bottom side adjacent the thumb rest, the bottom side of the second body member having a second lower extent being spaced from a first lower extent to form a lateral gap therebetween; and an adjustable bracket being sized for receiving an aerosol can, the adjustable bracket having a support plate with an elongated second extent, the elongated second extent being sized and shaped to be positioned within the lateral gap of the second body portion of the L-shaped body member.

3. The easy spray can holder as set forth in claim 2, including a reinforcement bar connected to the first and second linear portion of the trigger arm.

4. The easy spray can holder as set forth in claim 2, wherein the trigger extension of the first linear portion having an angular edge for engaging a nozzle end of the aerosol can, and the finger grip of the second linear portion having at least four openings therethrough.

5. The easy spray can holder as set forth in claim 2, wherein the L-shaped body member being formed by an L-shaped first section and an L-shaped second section configured similarly to the L-shaped first section, and a plurality of means for selectively coupling the L-shaped first section and the L-shaped second section to form the L-shaped body member.

6. The easy spray can holder as set forth in claim 2, wherein the first linear portion of the trigger arm projects from the upper member of the first body portion and rotates about a pivot pin within the first body portion, the second linear portion extending from the bottom side of the second body portion and having the finger grip being spaced from the lower member of the first body portion.

7. The easy spray can holder as set forth in claim 2, wherein the second body portion having a front plate that extends from an upper side thereof, and the front plate having an upper overhang for gripping an upper edge of the aerosol can and a first lower extent for capturing a lower edge of the aerosol can.

8. The easy spray can holder as set forth in claim 2, wherein the elongated second extent being movable within the lateral gap for increasing and decreasing the distance between the support plate and the second body portion, the elongated second extent being lockingly held within the lateral gab by a thumb screw.

* * * * *